United States Patent [19]

Anderson

[11] 4,100,053

[45] Jul. 11, 1978

[54] FLEXIBLE COVER FOR A CHLORINE CELL

[75] Inventor: Ralph F. Anderson, Akron, Ohio

[73] Assignee: The B. F. Goodrich Company, Akron, Ohio

[21] Appl. No.: 858,234

[22] Filed: Dec. 7, 1977

[51] Int. Cl.[2] ..... C25B 9/00; C25B 1/40

[52] U.S. Cl. ..... 204/279; 204/128; 204/250

[58] Field of Search ..... 204/279, 128, 250

[56] References Cited

U.S. PATENT DOCUMENTS

| | | | |
|---|---|---|---|
| 2,998,374 | 8/1961 | Granfors | 204/279 X |
| 3,450,621 | 6/1969 | Anderson | 204/279 X |
| 3,794,577 | 2/1974 | Oliver et al. | 204/279 X |

*Primary Examiner*—John H. Mack
*Assistant Examiner*—D. R. Valentine
*Attorney, Agent, or Firm*—W. A. Shira, Jr.; H. F. Pepper, Jr.

[57] ABSTRACT

An improved flexible sheet elastomer cover for sealing the electrolyte tank of a De Nora type chlorine generating cell. Elastomer materials of different compositions are used for the opposite surfaces of the cover with the inside surface composed of a chlorinated polyethylene compound and the outside surface composed of an ethylene-propylene terpolymer compound.

6 Claims, 3 Drawing Figures

FIG. 1
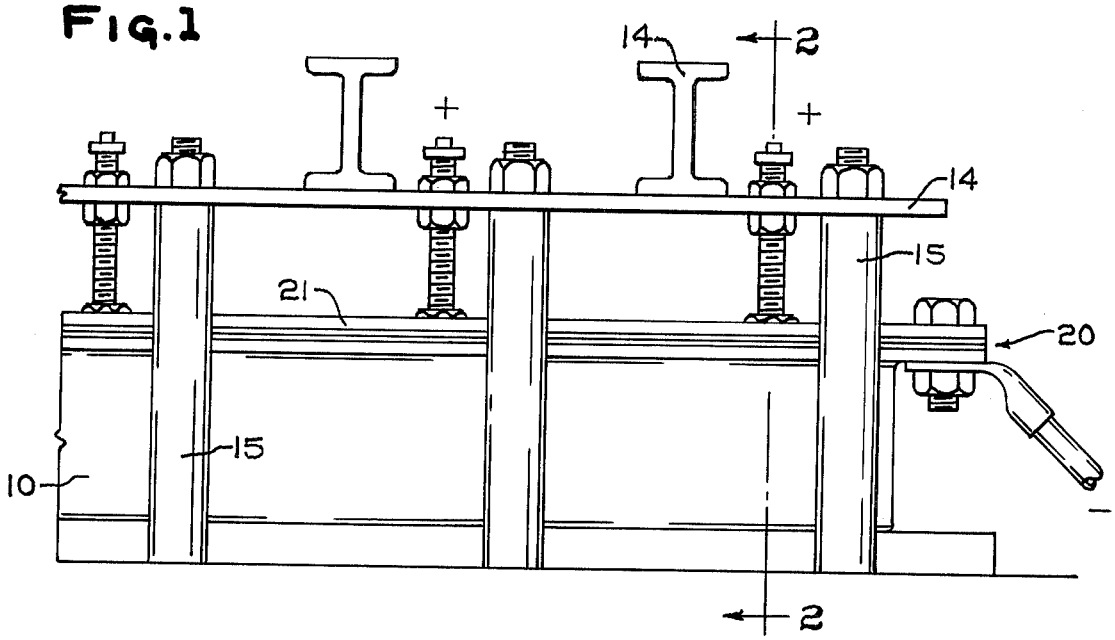
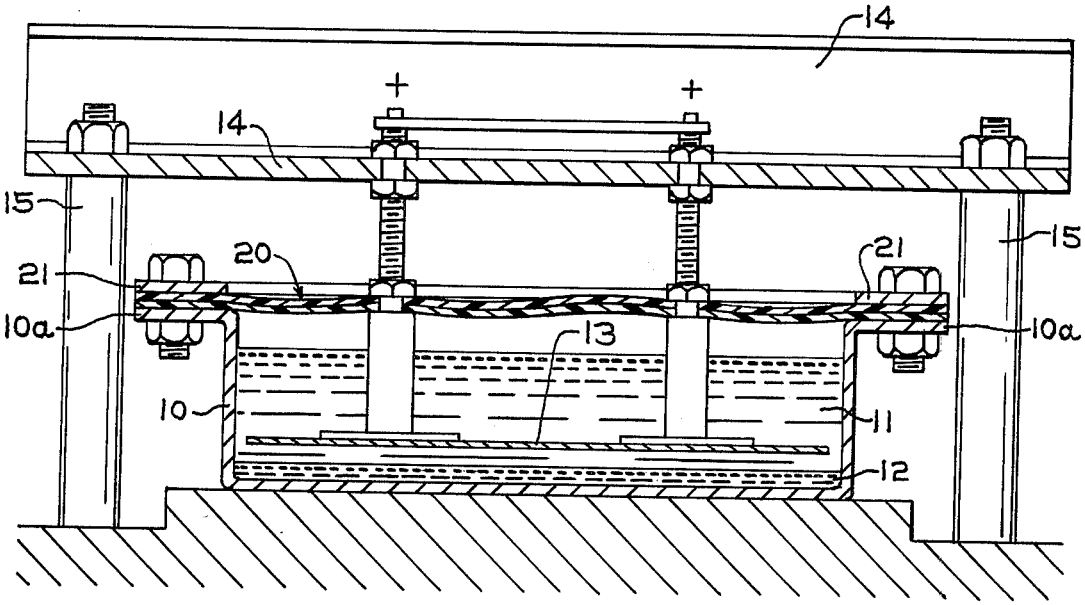
FIG. 2
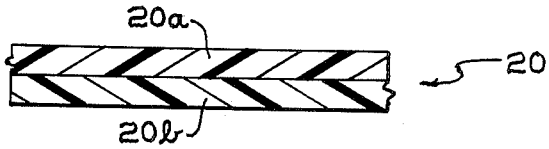
FIG. 3

FLEXIBLE COVER FOR A CHLORINE CELL

BACKGROUND OF THE INVENTION

This invention relates to a cover for a free chlorine generating cell and, in particular, relates to a flexible elastomer cover for a De Nora type chlorine generating cell. This type of cell uses an electrolytic process for producing free chlorine gas from sodium chloride. In such a cell, carbon or metal electrodes are employed for the anode and a pool of mercury is the cathode. The terminals of the carbon or metal anodes enter the tank by passing vertically through the cover and are adjustably mounted to permit maintenance of a constant electrolytic gap. The chlorine gas is evolved at the anodes and hence it is necessary to provide a seal between the anode terminals and the cover to prevent the gas from escaping except through the discharge opening. The cover must, therefore, not only seal around the terminals of the adjustable anodic electrodes but also at the periphery of the tank. It must also remain flexible to permit electrode adjustment.

The De Nora type cell operates continuously at an elevated electrolyte temperature which may be in the order of 180° to 190° F. (82.22° to 87.78° C.) Therefore, the flexible cover is subjected to the continuous corrosive attack of hot chlorine gas on the surface thereof disposed on the inside of the tank. In addition, a high concentration of ozone is present in the region around the terminals of the anodic electrodes on the outside surface of the cover. This subjects the flexible cover to two different corrosive media simultaneously on opposite sides causing embrittlement, cracking, scaling and other types of deterioration requiring frequent replacement.

Attempts to reduce deterioration and increase the life of such cell covers has included forming the covers as a laminate of: neoprene and polyisoprene, as described in U.S. Pat. No. 2,998,374; chlorosulfinated polyethylene and polyisoprene, as disclosed in U.S. Pat. No. 3,794,577; or, natural rubber and ethylene-propylene terpolymer, as disclosed in U.S. Pat. No. 3,450,621. The laminate type cover has resulted in improved life over the all rubber covers as originally employed for these cells but further improvement in the useful life of the covers has been sought.

SUMMARY OF THE INVENTION

The present invention provides an improved flexible elastomeric cover for an electrolytic cell in which free chlorine is generated, the cover being an integral laminated sheet with the face thereof that is adapted to be exposed to free chlorine formed of a compound the principal ingredient of which is chlorinated polyethylene and the opposite face formed of a compound the principal ingredient of which is an ethylene-propylene terpolymer material which is resistant to ozone.

The layer of the cover that is exposed to free chlorine may have its elastomer component comprised entirely of chlorinated polyethylene or may have a minor amount of natural rubber or other elastomers blended therewith. In addition, that layer as well as the outer layer, may include reinforcing pigments, fillers, plasticizers, curing agents and other ingredients commonly employed in cured elastomer compounds. The total thickness of the cover, as well as that of the layers thereof, may vary. However, the presently preferred total thickness of the cover is in the range of ⅛ to ¼ inch (0.175 to 0.635 cm.) with two layers of approximately equal thickness. However the chlorinated polyethylene layer may be of lesser or greater thickness than the outer layer of ethylene-propylene terpolymer.

The novel features of the invention will be more readily apparent from the following description of the presently preferred embodiment, and certain modifications thereof, described with reference to the accompanying drawings, forming a part of this application.

BRIEF DESCRIPTION OF THE DRAWINGS

FIG. 1 is a partial side elevational view, showing the presently preferred embodiment of cover installed in a De Nora chlorine generating apparatus;

FIG. 2 is a transverse sectional view, taken along the section-indicating lines 2—2 of FIG. 1; and, FIG. 3 is a fragmentary cross sectional view, to an enlarged scale, of the improved cover.

DETAILED DESCRIPTION

The drawings illustrate an electrolytic cell of the De Nora type as including a tank 10 having a flat horizontal rim flange 10*a* round the periphery of the open top. The cell is shown as partially filled with brine electrolyte 11 overlying the cathodic electrode 12 which consists of a thin layer of mercury at the bottom of the tank. The several spaced anodic electrodes 13 are made of carbon blocks or metal adjustably suspended from an overhead rigid supporting structure 14, here shown as a plate reinforced with I-beams, which is independently supported by vertical pillars 15 spaced uniformly around the tank. The carbon or metal anodes 13 are secured vertically in an adjustable manner by terminal members including fastening means, preferably threaded shafts and lock nuts, to facilitate maintaining a constant gap between the anodes and the mercury cathode.

The cell 10 has a flexible cover 20 which is sealed around the flange 10*a* of the tank by being clamped intermediate a frame 21 and the flange 10*a*. External securing means, which may be C-clamps but are here shown as machine bolts and nuts, with the bolts passing through the matching holes in the frame, cover and flange, are employed to sealingly clamp the cover between the frame and the flange. The cover 20 is also provided with holes through which threaded portions of the terminals for anodes 13 extend with sealing between each terminal and the flexible cover being effected by the lock-nuts on the threaded portions, which are tightened sufficiently to clamp the cover between the said nuts and integral shoulders on the terminals.

The improved flexible cover 20 is shown, in its presently preferred embodiment, as a unitary sheet of two layers of different elastomeric material integrally united by being vulcanized together. The upward or outside layer 20*a* is of uniform thickness and is made of sulfur-curable terpolymer of ethylene, propylene and a non-conjugated diene, commonly known as EPDM. The downward or inside layer 20*b* is also of uniform thickness and is made of a chlorined polyethylene composition.

The improved cell cover has exhibited a much longer trouble-free life with fewer difficulties in cell operation, such as contamination of the electrolyte by deposits on the cover falling therefrom, than has heretofore been possible with prior cell covers. The longer life is due to the fact that the chlorinated polyethylene on the underside of the cover has high resistance to erosion and other deterioration by the hot chlorine gas, in contact with this surface of the cover, while the ethylene-propylene terpolymer resists deterioration by the high ozone content of the atmosphere in contact with the outer surface of the cover.

The following is an example of a suitable composition for the outside layer 20*a:*

| Ingredients | Parts by Weight |
|---|---|
| EPDM | 180.0 |
| Chlorosulfinated polyethylene | 5.0 |
| Zinc Oxide | 5.0 |
| methylated paraffinic resin | 5.0 |
| Stearic acid | 1.0 |
| FEF Carbon black | 160.0 |
| Paraffin oil | 45.0 |
| mercaptobenzothiazole | .65 |
| tetramethylthuram disulfide | .90 |
| Sulfur master batch (80% sulfur) | 2.50 |
| | 405.05 |

In the above composition the EPDM was in the form of a blend of 160 parts by weight of Epcar ® 5465 and 20 parts of Epcar ® 346, both sold by The BFGoodrich Company, which has identified the terpolymer 5465 as having a Mooney of 53 at 257° F. (125° C.) and a specific gravity of 0.90, while the terpolymer 346 has a Mooney of 30 at 212° F. (100° C.) and a specific gravity of 0.86.

The following is an example of a suitable composition for the inner layer 20*b:*

| Ingredients | Parts by Weight |
|---|---|
| Chlorinated polyethylene | 80.0 |
| Natural Rubber | 20.0 |
| Magnesium oxide | 10.0 |
| Peroxide | 8.0 |
| Desiccant 12.0 | |
| Carbon black | 75.0 |
| Paraffin oil | 10.0 |
| Dioctyl phthalate | 10.0 |
| Epoxy polymeric plasticizer | 10.0 |
| Triallyl isocyanurate | 1.0 |
| | 236.0 |

The chlorinated polyethylene in the above compound was that sold under the designation CM0136 by the Dow Chemical Company. It is reported to have a specific gravity of 1.16, a chlorine content of 36% an average Mooney of 80 at 250° F. (121.11° C.)

The ethylene-propylene terpolymer comprising the outside surface 20*a* of the improved cover may be any one of the elastomers presently available under that designation and having characteristics which provide a flexible sheet when calendered to a thickness of ¼ inch (6.35 mm.) or less. The inner layer 20*b* may have the entire elastomer content thereof comprised of chlorinated polyethylene rather than employing a small quantity of another elastomer, which may be synthetic or natural cis-polyisoprene as in the above example. However, when no other elastomer, such as cis-polyisoprene, is present in the blend it may be necessary to provide a cement or tie-gum between the two layers. Also, chlorinated polyethylene polymers having a chlorine content greater than 36% may be employed, as for example those which have a chlorine content up to 48%. It will also be evident that the other ingredients in the compounds comprising the layers 20*a* and 20*b* may be varied in accordance with known elastomer compounding techniques.

The improved cover 20 is preferably made by separately calendering the compositions comprising the two layers to a thickness for each having a maximum gauge of 0.030 inch (0.76 mm.) and sufficient plies of the material for each layer are then laminated to provide the desired thickness of the layer. The thickness of the outer layer 20*a* may be equal to, less or greater than that of the inner layer 20*b* with the overall thickness of the combined layers, and hence of the total cover, ranging in size from 0.125 to 0.250 inch (3.175 to 6.35 mm.). In the embodiment employing the compositions above identified the outer layer 20*a* had a thickness of 0.081 inch (2.06 mm.) while the inner layer 20*b* had a thickness of 0.107 inch (2.72 mm.) with the total thickness of the cover being 0.188 inch (4.78 mm.). The plies of calendered material comprising the inner layer 20*b* were laminated to the plies comprising the layer 20*a* and the thus laminated material was then wound with an appropriate fabric liner upon a cylindrical drum, the assembly wrapped with a textile cover, placed in an autoclave and vulcanized. Following vulcanization the vulcanized cover 20 was then trimmed to size and punched at appropriate locations for receiving the threaded shafts of the anode terminals and the cell cover fasteners.

Although certain specific compositions and several modifications thereof have been described, as well as the preferred manner in which the improved cell cover is manufactured, it will be apparent that modifications and adaptations from the specifically disclosed materials and procedures may be made by those skilled in the art without exceeding the ambit of the invention which is limited only as required by the spirit and scope of the appended claims.

I claim:

1. A flexible elastomeric cover for an electrolysis cell in which free chlorine is generated, the said cover comprising an integral laminated sheet with the face thereof that is adapted to be exposed to free chlorine formed of a compound the principal ingredient of which is chlorinated polyethylene and the opposite face formed of a compound the principal ingredient of which is an ethylene-propylene terpolymer material which is resistant to ozone.

2. A flexible elastomeric cover for an electrolysis cell as defined in claim 1 wherein the face which is exposed to chlorine is a blend of chlorinated polyethylene and another elastomer.

3. A flexible cover for an electrolysis cell as defined in claim 2 wherein the other elastomer is cis-polyisoprene.

4. A flexible elastomeric cover for an electrolysis cell as defined in claim 1 wherein the elastomer of the face which is exposed to chlorine is entirely chlorinated polyethylene.

5. A flexible elastomeric cover for an electrolysis cell as defined in claim 1 wherein the chlorinated polyethylene has a chlorine content of 36% and an average Mooney of 80 at 250° F.

6. A flexible elastomeric cover for an electrolysis cell as defined in claim 1 wherein the total thickness is 0.125 to 0.250 inch and the thickness of the chlorinated polyethylene is 0.030 to 0.110 inch.

* * * * *